US006705072B2

(12) United States Patent
Anderegg et al.

(10) Patent No.: US 6,705,072 B2
(45) **Date of Patent: *Mar. 16, 2004**

(54) SPINNING DEVICE

(75) Inventors: Peter Anderegg, Winterthur (CH); Robert Wehrli, Oberuzwil (CH)

(73) Assignee: Maschinenfabrik Rieter AG, Winterthur (CH)

( * ) Notice: Subject to any disclaimer, the term of this patent is extended or adjusted under 35 U.S.C. 154(b) by 42 days.

This patent is subject to a terminal disclaimer.

(21) Appl. No.: 10/022,806

(22) Filed: Dec. 18, 2001

(65) Prior Publication Data

US 2002/0150643 A1 Oct. 17, 2002

(30) Foreign Application Priority Data

Dec. 22, 2000 (CH) ..... 2515/00

(51) Int. Cl.[7] ..... D01H 4/02

(52) U.S. Cl. ..... 57/400; 57/315; 57/333; 57/350

(58) Field of Search ..... 57/261, 263, 280, 57/301, 304, 315, 333, 350, 400, 401, 403; 28/222, 232, 235, 237, 268, 272

(56) References Cited

U.S. PATENT DOCUMENTS

| | | | | | |
|---|---|---|---|---|---|
| 4,796,340 | A | * | 1/1989 | Gerhards | 28/248 |
| 5,193,335 | A | | 3/1993 | Mori | |
| 5,528,895 | A | * | 6/1996 | Deno | 57/328 |
| 5,704,204 | A | * | 1/1998 | Mima et al. | 57/280 |
| 6,314,714 | B1 | * | 11/2001 | Feuerlohn et al. | 57/343 |
| 2002/0124543 | A1 | * | 9/2002 | Bischofberger et al. | 57/5 |

* cited by examiner

*Primary Examiner*—John J. Calvert
*Assistant Examiner*—Shaun R Hurley
(74) *Attorney, Agent, or Firm*—Dority & Manning

(57) ABSTRACT

The invention relates to a spinning device for the production of a spun thread from a fiber bundle, including a nozzle part with an upper nozzle part and a lower nozzle part. Likewise, a spindle is included with an upper part and a lower part. In order to be able to carry out cleaning work between an edge of a fiber guide surface opposite an intake mouth of the spindle, or, at the start of the spinning, in order to be able to guide a yarn end through a yarn guide channel of the spindle onto the fiber guide surface, the upper nozzle part is capable of being raised or can be pivoted. In this situation, the lower nozzle part may remain stationary.

7 Claims, 5 Drawing Sheets

Fig.6.1
G
G.1
F
F.1
6
7
8
9
10
11
12
13
14
15
16
17
25
26
38
39
40
41
42
III
IV
V

Fig.7.1
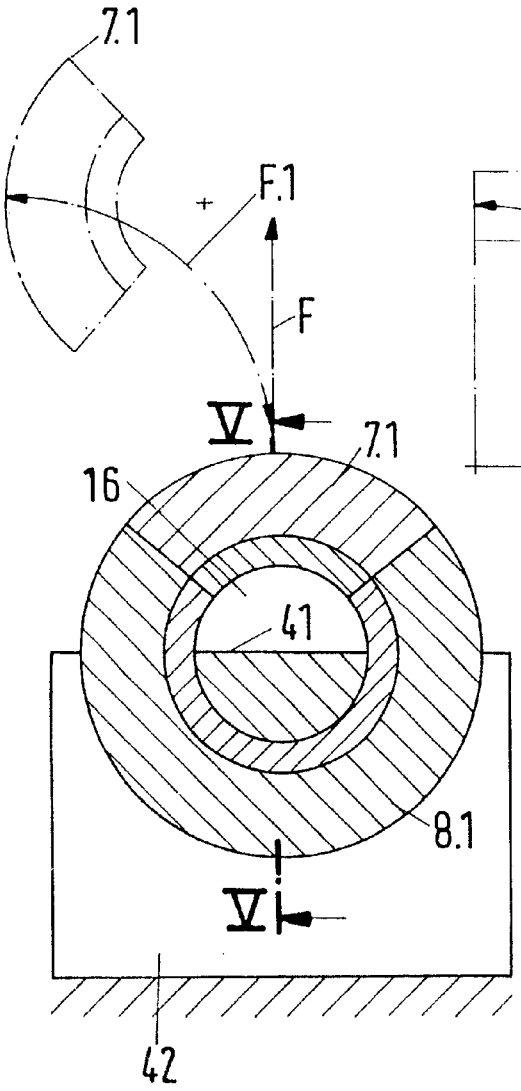
Fig.8.1
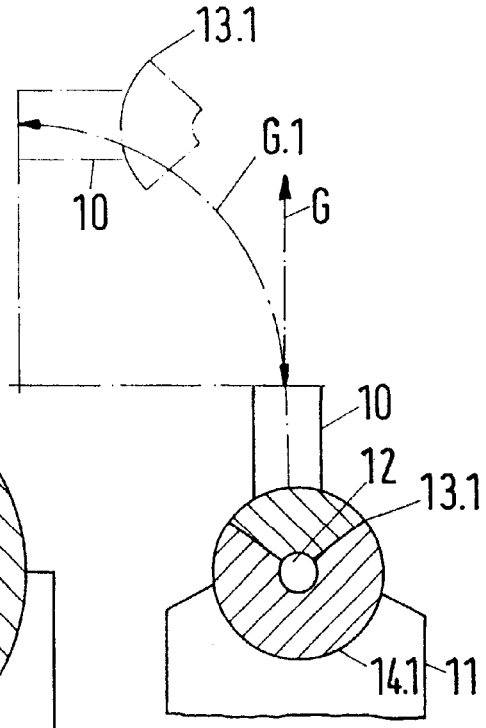

SPINNING DEVICE

FIELD OF THE INVENTION

The invention relates to a spinning device for the production of a spun thread from a fiber bundle, comprising a nozzle block with a fiber conveying channel, with a fiber feed surface for guiding the fibres and with a nozzle part with one or more nozzles, which impose a rotating air flow onto the fiber bundle, and a rotating or stationary hollow spindle with an intake mouth to a yarn channel for taking up the fibres delivered from the fiber feed surface and for guiding the spun thread.

BACKGROUND

In such a spinning device, the fibres are either guided by a drafting device or a suction drum against the fibre conveying channel, and are guided in this channel into the intake mouth of a rotating or stationary hollow spindle. The front ends of such fibres are guided in the fibre bundle and in the intake mouth or in the yarn channel respectively, while rear free ends are splayed and taken up by the rotating air flow, and are rotated around the front ends, already located in the intake mouth or in the yarn channel respectively, i.e. the bundled front ends, in order thereby to produce a yarn with real twist, similar to a ring-spun yarn. It may be noted that the term "front" and "rear" ends of the fibres were selected in connection with the direction of conveying of the fibres.

In practice, however, the distance between the outlet of the fibre conveying channel and the intake mouth of the spindle is very small, for example one millimeter, with the result that the spinning process has a certain sensitivity to dirt particles, in particular to small fragments of shell particles. In the event of a fault, it is therefore necessary for the distance between the spindle and the fibre conveying channel to be widened, in such a way that a cleaning process becomes possible.

A further need for the spindle to be separated from the fiber conveying channel and from the nozzles respectively, arises during spinning starting, since for starting a yarn end of the yarn which was last spun must be brought back through the spindle in the direction of the fiber guide channel, and possibly even further through this fiber guide channel against the delivery rollers of a drafting device delivering the fibres.

For this purpose, the prior art in DE 4308392 A 1 (U.S. Pat. No. 5,419,110) provides for the spindle to be capable of being moved backwards from the spinning unit in an axial direction sufficiently far for a suction element located in between to be able to suck the yarn end through the spindle and bring it against the spinning unit.

In a further example of the prior art, in EP 807699 A 2 (U.S. Pat. No. 5,813,209), such a method is additionally supplemented by a blower device, by means of which the yarn end is blown through the fiber conveying channel against the pair of delivery rollers of the drafting device, in order, at the start of spinning, for the yarn end to be joined to the newly delivered fibres from the drafting device.

The disadvantage of these methods lies in the elaborate process stages as well as in the elaborate device which guides the elements apart in the axial direction of the spinning process. Also, auxiliary elements must be introduced in between in order for finally bringing the yarn end to that position at which it should be for it to be introduced to the fibres being delivered. This leads to the fact that such devices are, as a rule, arranged vertically, i.e. the drafting device takes up the fibre bundle from the spinning device from a container located beneath it, and, as a rule, delivers the finished fibre bundle in the vertical direction to the spinning unit. This arrangement is the most purposeful with regard to the operation of the spinning unit, since the operating personnel have a good overview of the spinning process and good access for the operation of the spinning elements. As a rule, also, the spooling unit is designed as far as possible in such a way that it can be served from the same side of the machine. If, as mentioned earlier, the elements of the whole unit now need to be guided apart from one another in the direction of spinning in order to, for example, introduce assistance media between them or for spinning start-up (also called piecing), then this necessity to move them apart leads to an inconveniently long, i.e. high, arrangement which is not favourable for the operating personnel.

SUMMARY

It is therefore an object of the invention to simplify the method of cleaning the spinning location or spinning start-up. Additional objects and advantages of the invention will be set forth in part in the following description, or may be obvious from the description, or may be learned through practice of the invention.

Objects of the invention are solved in that at least the fibre conveying channel is capable of being divided and opened in such a way that the fibre guide surface is exposed and accessible.

As an advantage, the nozzle section is also capable of being divided and opened in such a way that is exposed and accessible. It is further of advantage for the spindle to be designed as capable of being divided accordingly in such a way that the yarn channel is exposed and accessible.

The advantage of the invention lies in the fact that all three of the elements mentioned can be opened in a direction perpendicular to the direction of spinning, without the axial dismantling of the entire spinning unit, with the result that accessibility is optimally provided to the critical point between the intake mouth of the spindle and the outlet point of the yarn guide channel.

The invention is presented on the basis of a number of embodiments shown in the drawings as examples.

BRIEF DESCRIPTION OF THE DRAWINGS

FIG. 7.1 A variant of the device from FIG. 7

FIG. 8.1 A variant of the device from FIG. 8

DETAILED DESCRIPTION

Figures 1, 2:
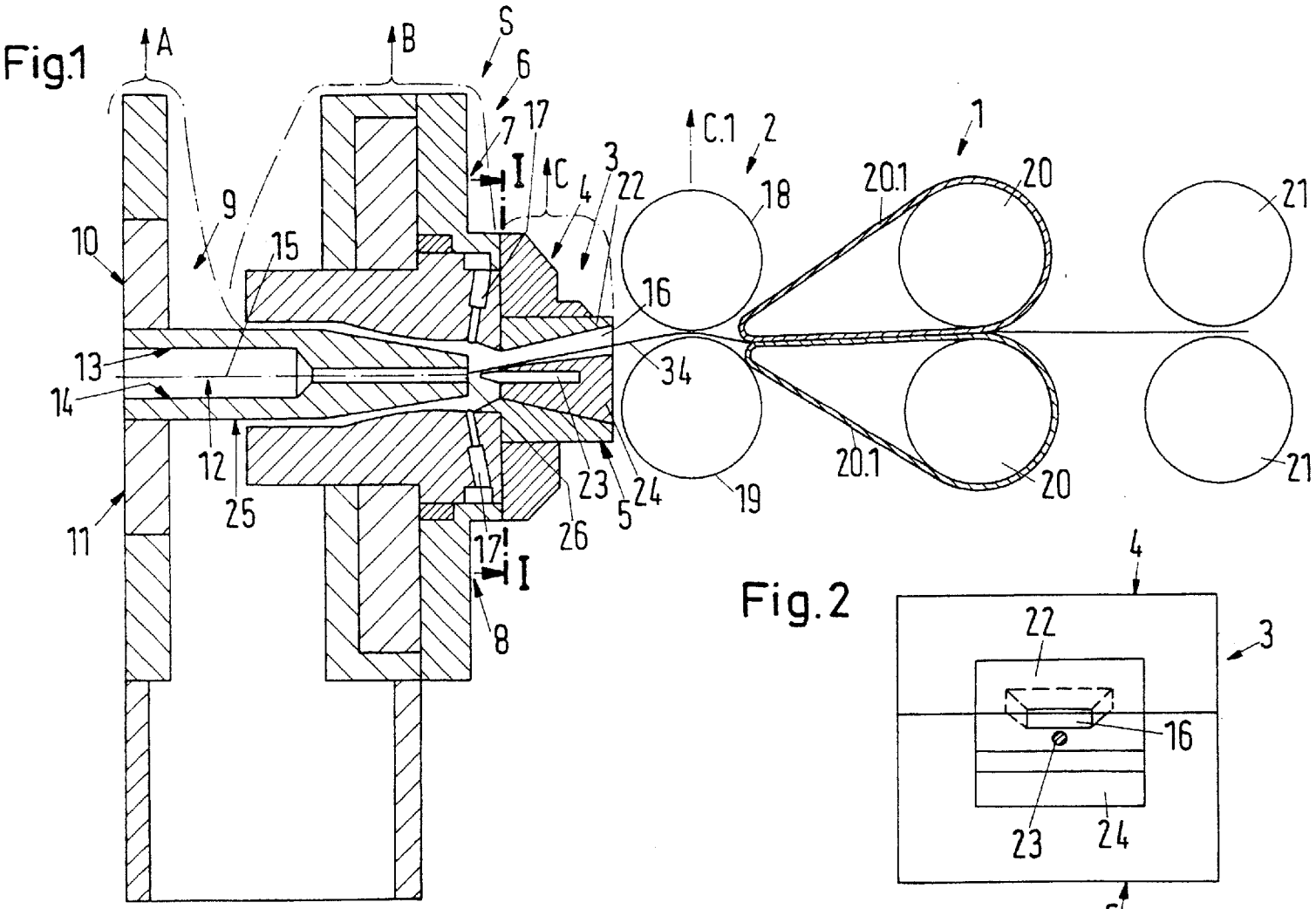
FIG. 1 A longitudinal section through a drafting device and through a spinning unit, represented in part in a semi-diagrammatic manner FIG. 2 A view along the section line I—I FIG. 3 A longitudinal section through a variant of the spinning device from FIG. 1

Reference will now be made in detail to embodiments of the invention illustrated in the figures. Each embodiment is presented by way of explanation of the invention, and not meant as a limitation of the invention. For example, features illustrated or described as part of one embodiment may be used in another embodiment to yield still a different embodiment. It is intended that the present invention include these and other modifications and variations. FIG. 1 shows a drafting device 1 with intake rollers 21, and middle rollers 20 with belts 20.1, which convey fibers against a pair of delivery rollers 2, which in turn convey the fibres further into a fibre conveying channel 16. The delivery rollers 2 consist in turn of an upper delivery roller 18 and a lower delivery roller 19.

The fibre-processing spinning unit (S) comprises, following the delivery rollers 2, a fibre conveying part 3, consisting of an upper fibre conveying part 4 and a lower fibre conveying part 5. These are followed by a nozzle part 6 with blower nozzles 17, which are arranged in an inherently known manner in such a way that, on the one hand, as a result of an injector effect, air is sucked in through the fibre conveying channel 16 and, on the other, in an inherently known manner, this air, as a turbulent flow, takes up free ends (for reference "rear ends") of the fibres delivered, and winds them around the front ends already located in the mouth section 26 of a yarn guide channel 12, i.e. already bound ends, and thus rotate them to form a yarn.

A needle-like element extends in this situation at or even into the mouth section 26, as a result of which a relatively narrow passage space pertains for the fibres passing into the mouth 26, which may possibly lead to problems if dirt particles, such as fragments of cotton seeds, become jammed in between them, with the result that an immediate interruption occurs in spinning and yarn production.

In such a case, according to the prior art, the spindle 25 must be drawn back in the axial direction in order to clean the space between the mouth 26 and the needle 23, and, as mentioned heretofore, a suction element must also be located at the mouth 26 in order to take the yarn end back again so as to bring it to or through the fibre guide channel 16.

To facilitate this, at least the fibre conveying part 3 is designed to be capable of being divided, in that the upper fibre conveying part 4, together with a channel part 22 pertaining to it, can be raised in the direction of the arrow C or pivoted away, so that the fibre conveying channel 16 is free and the area in front of the mouth 26 is accessible. In this situation, the lower fibre conveying part 5, together with the needle part 24, remains stationary.

As a variant there is also the possibility of the nozzle part 6, with everything surrounded by the broken line and united in the arrow B, i.e. also including the nozzles 17, being raised or pivoted away, in order thereby to create more free space for cleaning. In this situation, the lower nozzle part 8, and the nozzle 17 shown in it, remain stationary.

A further variant consists of the yarn guide part 9, together with an upper part 13 of the spindle 12 and an upper yarn guide part 10, being raised or pivoted in the direction of the arrow A, after the nozzle part G has been raised or pivoted in the direction B, so that the yarn guide channel 12 is also exposed for cleaning. In this situation, a lower yarn guide part 11 together with a lower part 14 of the spindle 25 remains stationary.

The advantage of opening the three elements referred to heretofore not only provides the advantage of cleaning, but also the advantage of simple recovery of a yarn end, which in turn is to be laid in the lower part 14 and in the open fibre conveying channel 16, in order for this end to be brought even by hand between the entrance to the fibre delivery channel 16 and the delivery rollers 2.

A further possibility consists of the upper delivery roller 18 being raised or pivoted in the direction of the arrow C.1, in order for the foresaid yarn end to be brought still further beneath the upper delivery roller, in order thereby to unit this yarn end, as shown, with the newly delivered fibers in front of the pair of delivery rollers 2.

In this context, the actual mechanical elements for raising or pivoting the elements are not objects of this invention.

FIG. 2 is therefore not shown as a section, but as a separated element, since this involves an element which is capable of being separated from the nozzle part 6.

Figure 3:
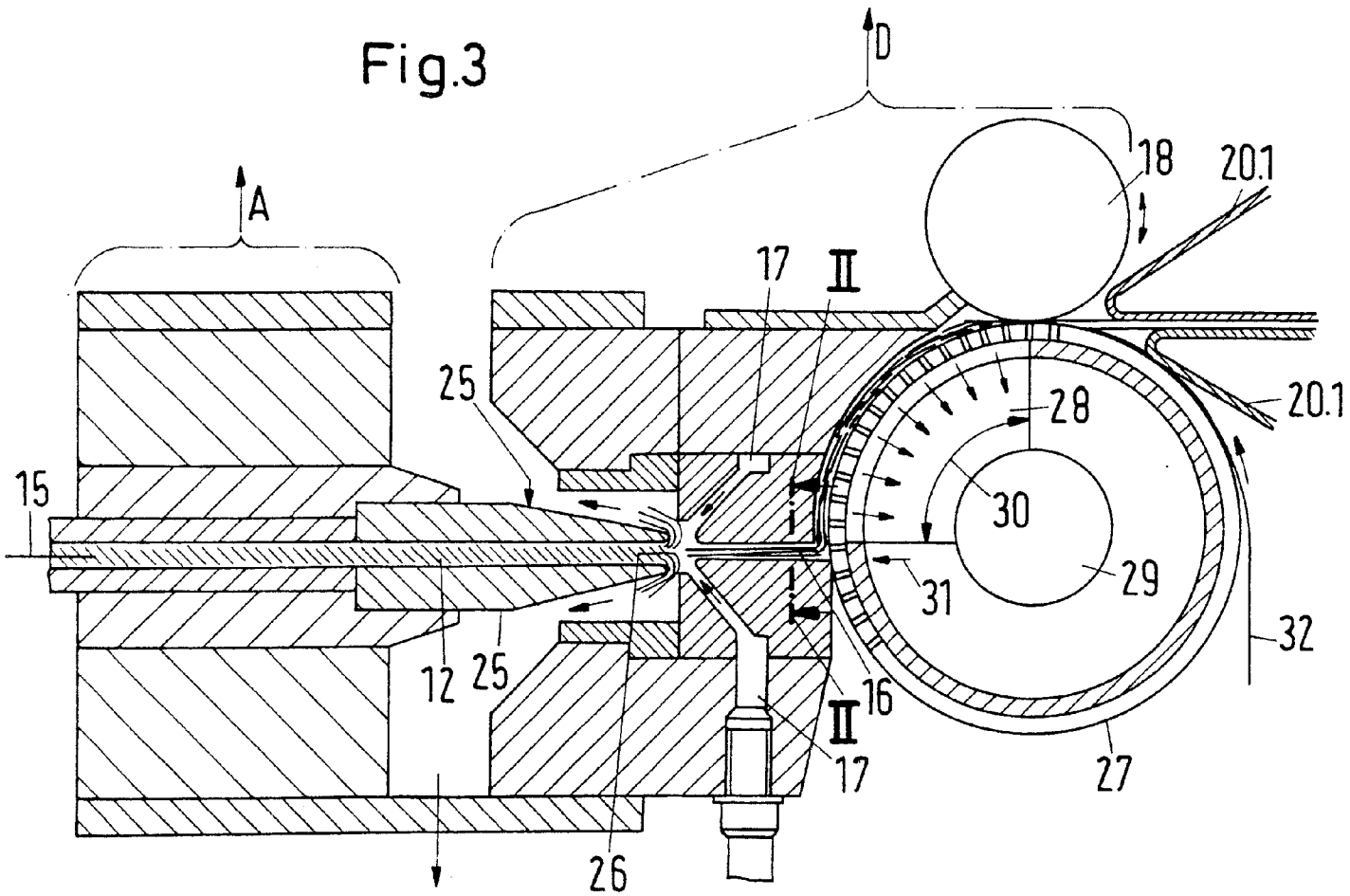
Figure 4:
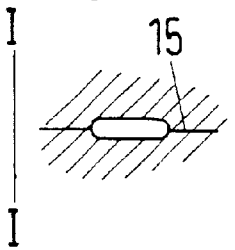
FIG. 4 A detail section from FIG. 3

FIG. 3 shows, as mentioned, a variant of the device from FIG. 1, in which, instead of a pair of delivery rollers 2, the upper delivery roller 18 interacts with a suction roller 27, with a suction air connection in order to draw fibres out from the pair of belts, at the clamping point between these two rollers, and delivering them against the fibre conveying channel 16 in the area 30 of the suction segment 28 on the suction roller by means of the rotation of the suction roller and the suction effect, and, by means of the blowing air 31, thereafter blowing them into the fibre conveying channel 16 at the suction area 30, and in this way supporting the conveying air referred to heretofore, created by the injection effect of the nozzles 17.

In this variant, all the elements located beneath the broken lines and united in the arrow D are raised above the separation line 15 referred to heretofore.

The same applies to the elements comprised within the broken lines A, which can be raised or pivoted in the direction of the arrow A, in an analogous manner as described for FIG. 1.

Figure 5:
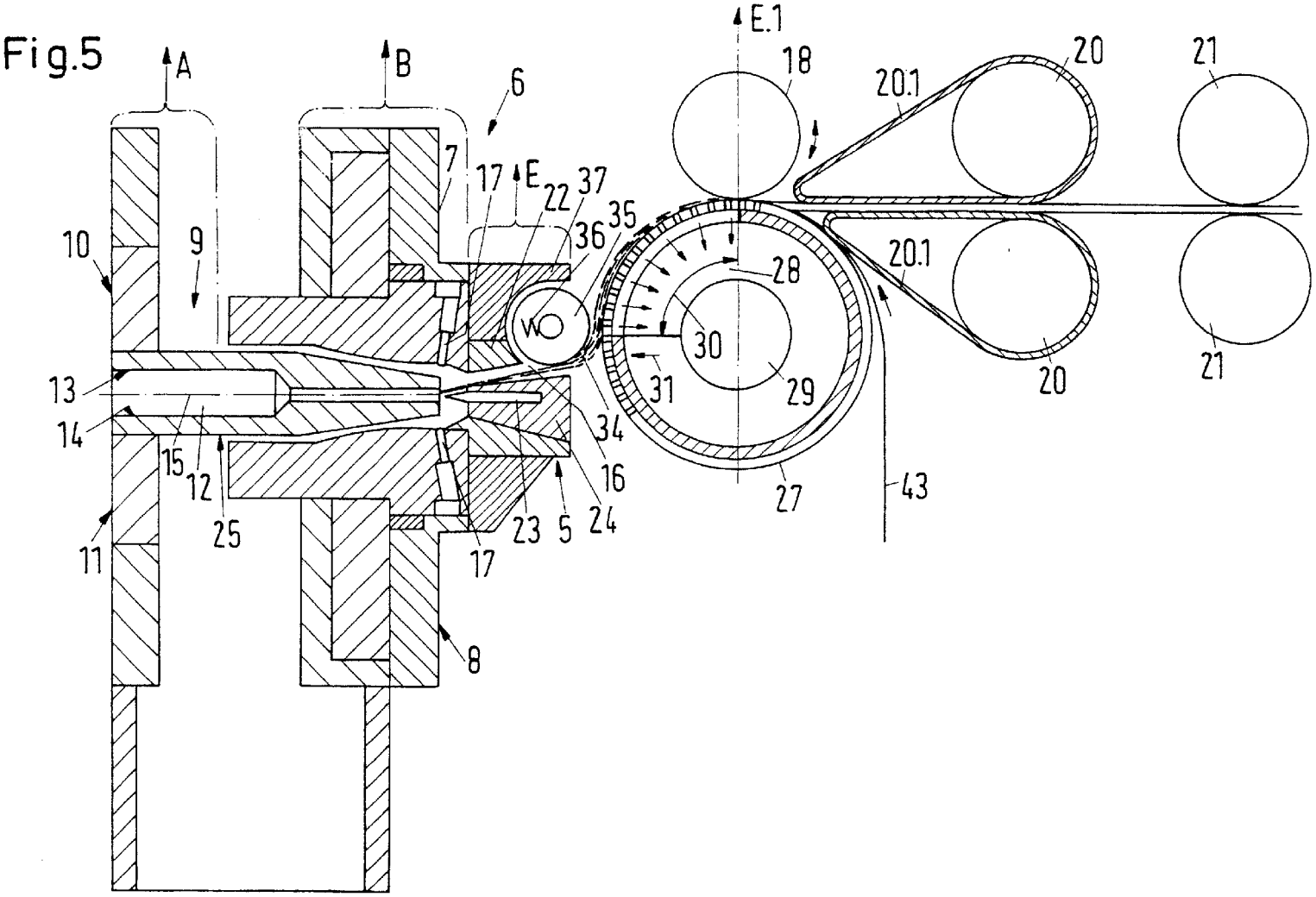
FIG. 5 A longitudinal section through a further variant of the spinning device from FIG. 1

FIG. 5 shows the same elements, encompassed by the letters A and B, while the section C of FIG. 1 features in FIG. 5 a variant, inasmuch as, instead of the lower delivery roller, a suction roller 27 is provided for, which interacts with the upper delivery roller 18 and forms a clamping gap. After this clamping gap, the fibres on the suction roller 27 are retained on the surface of the roller in the suction area 30, and at the end of this suction area 30 are blown by means of a blown air flow 31 against the fibre conveying channel 16, in which the air flow referred to takes up the fibres 34 and conveys them through the fibre conveying channel 16.

In order to form a second clamping line at the suction roller 27, a contact pressure roller 35 is mounted so as to exert spring pressure by means of contact pressure springs 36, so that the fibres on the surface of the suction roller are pressed with the force of the springs, in order thereby to achieve a more stable fiber delivery into the fiber conveying channel 16 than without this contact pressure roller 35.

The contact pressure roller 35 is, as mentioned, spring-mounted in a roller bearing part 37, whereby the roller bearing part 37 is permanently connected to a channel part 22.

By analogy with the elements in FIG. 1 circumscribed by the arrow C and the broken lines, the elements in Group E can be raised or pivoted upwards, in order to expose the fiber conveying channel 16, in order, for example, to transfer a yarn end coming from the spindle 12 to the suction roller 27.

The possibility likewise pertains of the upper delivery roller 18 being raised or pivoted away respectively, in accordance with the arrow E.1, so that the yarn end referred to can be guided about half the circumference of the suction roller 27, as is shown with the yarn end 43.

There is accordingly also the possibility, in accordance with this figure, not only of opening the fiber conveying channel 16 but also of raising the nozzle part circumscribed by the letter B and the spindle part circumscribed with the letter A, so that, on the one hand, cleaning can be carried out and, on the other hand peacing can be effected.

Figures 6, 7, 8, 9:
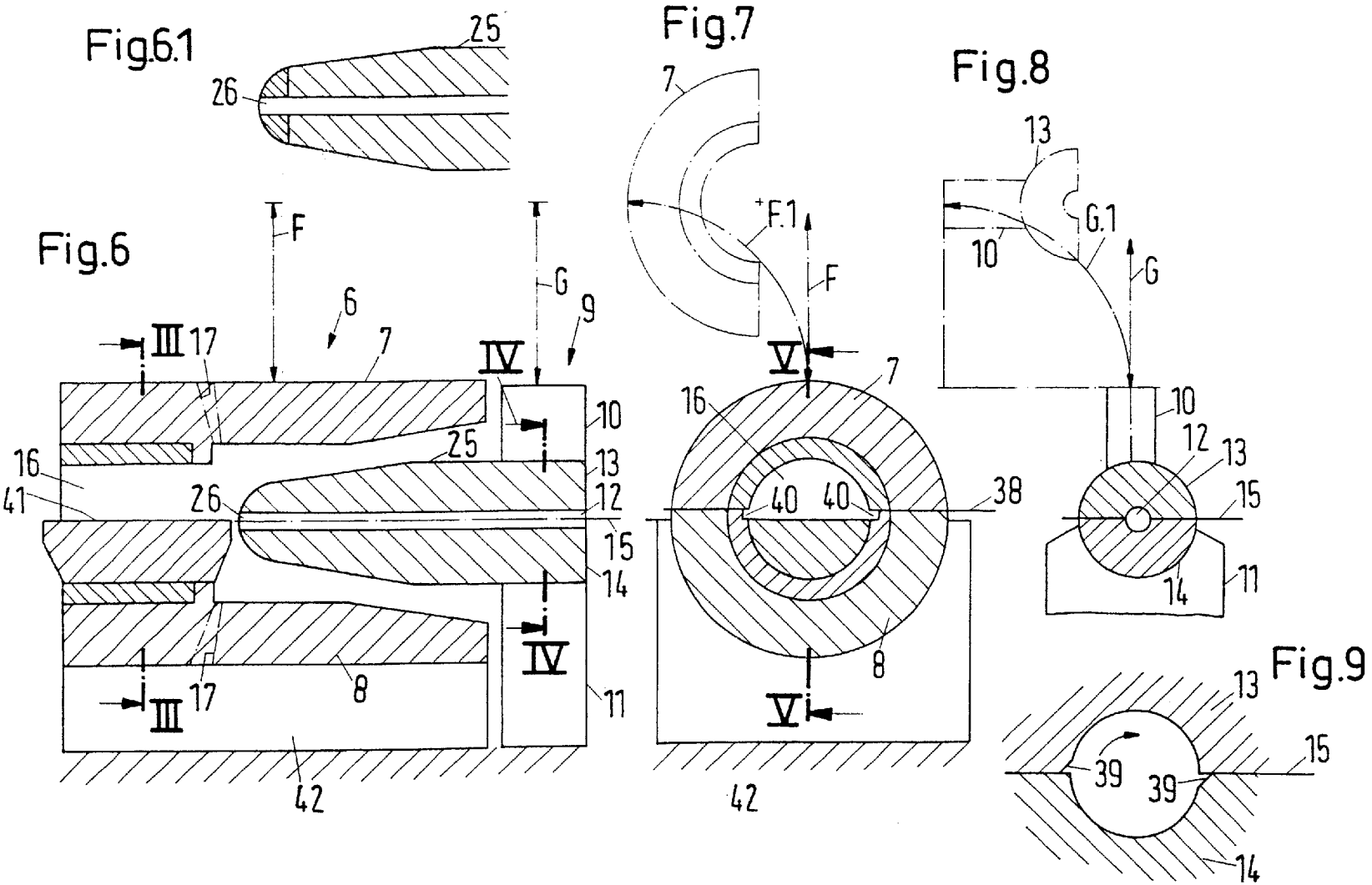
FIG. 6 A longitudinal section through a variant of the spinning device from FIG. 3 according to the sectional line V—V from FIG. 7
FIG. 7 A cross-section through FIG. 6 along the sectional lines III—III
FIG. 8 A cross-section through FIG. 6 along the sectional lines IV—IV
FIG. 9 A partial enlargement of FIG. 8

FIGS. 6 and 7 show in principle the same elements as those submitted in the application by the present assignee, applied for in Switzerland on Sep. 22, 2000 under No. 2000/1845/00. By contrast, the identification reference numbers no longer correspond with the same reference numbers as in the foresaid application. Likewise, certain elements have been modified in order to allow for the opening of the fibre conveying channel 16 and the spindle 25.

FIG. 6 accordingly shows a nozzle part 6 with an upper nozzle part 7, a lower nozzle part 8, in each of which blower nozzles 17 are provided. By means of these blower nozzles 17, of which a further two may be provided for, on the one hand a turbulent air flow is created, as already described in the foresaid application, by means of which free rear fiber ends are wound about front fiber ends, in order thereby to create a yarn which is drawn through the yarn guide channel 12 by drawing rollers, not shown here.

In the yarn guide channel 16 the fibres, which are brought onto a fiber guide surface 41 from the left, seen looking at the figure, by means of a suction air flow created by the injector effect of the nozzles 17, are brought onto the fiber guide surface 41 against an intake mouth 26 of the spindle 25, in order, as mentioned heretofore, to create the yarn.

In this case too, as already mentioned, there is a relatively narrow interval between the end edge of the surface 41 opposite the mouth 26, so that on the one hand the possibility pertains of having to carry out cleaning here, or readjustment, or, at the start or restart of spinning, of having to bring a yarn end from the yarn guide channel 12 via the fiber guide surface 41 to the left, seen looking at the figure, in order to bring this yarn end into contact with the newly delivered fibres which is called "piecing".

In order to be able to carry out the cleaning process referred to, as well as the piecing in an easy manner, the possibility pertains of raising the upper nozzle part 7 in the direction of the arrow F or pivoting it in a plane lying perpendicular to the middle 15 of the yarn guide channel. This allows the fiber guide surface 41 to be freely accessible.

The possibility likewise also pertains of raising or pivoting upwards an upper part 13 of the spindle 25 in the direction of the arrow G, whereby the upper part 13 is connected to an upper yarn guide part 10, to which the device, not shown, is secured.

In this case too, the device required for raising in the direction F is not shown and is not the object of the invention.

A lower part 14 of the spindle 25 is in turn connected to a lower yarn guide part 11, which remains stationary.

The separation of the upper part 13 and the lower part 14 is effected at the separation surface 15 of the spindle 25. In addition, the lower nozzle part 8 is securely connected to a carrier part 42, likewise stationary, so that the fiber guide surface 41 is likewise stationary.

FIG. 6.1 shows that the spindle 25 is provided in the area of the intake mouth 26 with a wear-resistant ring 22. In this context, this ring 22 is connected to the stationery part 14 or the movable part 13, because the spindle 25 is open, as described in FIGS. 8 and 9, with the result that sufficient clearance nevertheless still pertains for the cleaning referred to, or for the start or restart of spinning respectively.

On the other hand, the possibility pertains of this ring being likewise divided, according to FIG. 9, into an upper part connected to the upper part 13, and a lower part connected to the lower part 14. Likewise, the separation channels 39 can each be provided with a ring half, with the same advantage as described for FIG. 9.

FIG. 7 shows a cross-section according to the sectional lines III—III (FIG. 6), in which a separation surface 48 is shown, from which the upper nozzle part is raised in the direction F or F.1.

Channels 40 are also recessed, so as to avoid jamming of peripheral fibres at the separation surface.

In addition to this, the elements with the same identification reference numbers have the same functions as described in FIG. 6.

FIG. 8 shows a section through the spindle 25, according to the sectional lines IV—IV with the separation surface 15, which coincides with the mid-line of the spindle. The other identification reference numbers accord with the identification reference numbers in FIG. 6 and have the same function as in FIG. 6.

FIG. 9 shows an enlargement of the yarn guide channel 12 with the separation channel 15, whereby separation channels 39 are additionally provided for, in order, by analogy with the separation channels 40, to avoid the jamming of peripheral fibres in the clamping surface 15.

Further, the same identification numbers have the same functions as in the preceding figures.

FIG. 7.1 shows a variant of FIG. 7, in the event of the fiber conveying channel not being separable by means of a flat separation surface 38 (FIG. 7), but by means of a channel-shaped lower nozzle part 8.1 and a matching segment-shaped upper nozzle part 7.1.

This type of separation of the two parts provides the advantage that the separation channels 40, such as are shown in FIG. 7, can be done away with, because the separation of the segment-shaped upper nozzle part 7.1 is located substantially higher than the separation surface 38 in FIG. 7. As a result of this, there is even less risk of fibers being trapped in the separation area than with the separation channels 40 of FIG. 7.

The raising of this upper nozzle part 7.1 takes place in precisely the same way as for the upper nozzle part 7 in FIG. 7.

The same principle is applied in FIG. 8.1, in that the separation surface is not a plane like the separation surface 15 of FIG. 8, but is likewise provided as channel-shaped, in that the upper part 13.1 is provided as segment-shaped and matches accordingly with the channel-shaped lower part 14.1 in the sense of a sealing surface.

The principle applies here too that the segment-shaped upper part 13.1 is raised in the same manner as the upper part 13 in FIG. 8.

It should be apparent to those skilled in the art that modifications and variations can be made to the embodiments of the invention described herein without departing from the scope and spirit of the invention as set forth in the claims and their equivalents.

LEGEND

1. Drafting device
2. Delivery rollers
3. Fibre conveying part
4. Upper fibre conveying part

5. Lower fibre conveying part
6. Nozzle part
7. Upper nozzle part
7.1 Segment shaped upper nozzle part
8. Lower nozzle part
8.1 Channel-shaped lower nozzle part
9 Yarn guide part
10. Upper yam guide part
11. Lower yarn guide part
12. Yarn guide channel
13. Upper part of 12
13.1 Segment-shaped upper part of 12
14. Lower part of 12
14.1 Channel-shaped lower part of 12
15. Center an separation surface of 25
16. Fibre conveying channel
17. Blower nozzles
18. Upper delivery roller
19. Lower delivery roller
20. Middle rollers with 20.1 belts
21. Intake rollers
22. Wear-resistant ring
23. Thorn
24. Thorn part
25. Spindle
26. Intake mouth of 12
27. Suction roller
28. Suction segment
29. Suction air connection
30. Suction area
31. Blown air
32. Yarn end drawn back
33. Middle and separation surface of A and D
34. Fibres
35. Contact pressure roller
36. Contact pressure spring
37. Roller bearing part
38. Separation surface
39. Separation channels
40. Separation channels
41. Fibre guide surface
42. Carrier part
43. Yarn end

What is claimed is:

1. A spinning device for the production of a spun thread from a fiber bundle, comprising:

a nozzle block defining a fiber conveying channel having a fiber guide surface, said nozzle block further comprising a nozzle part with at least one nozzle disposed to subject the fiber bundle to a rotating turbulent air flow;

a spindle having a yarn channel with an intake mouth disposed to take up fibers delivered from said fiber guide surface and to guide the spun fibers;

wherein at least one of said yarn channel, said nozzle part, and said spindle is separable into parts along a separation line so as to open and provide access to an interior thereof.

2. The spinning device as in claim 1, wherein said spindle is stationary.

3. The spinning device as in claim 1, wherein said spindle is rotatable.

4. A spinning device for the production of a spun thread from a fiber bundle, comprising:

a nozzle block defining a fiber conveying channel having a fiber guide surface, said nozzle block further comprising a nozzle part with at least one nozzle disposed to subject the fiber bundle to a rotating turbulent air flow;

a spindle having a yarn channel with an intake mouth disposed to take up fibers delivered from said fiber guide surface and to guide the spun fibers;

wherein at least one of said yarn channel, said nozzle part, and said spindle is separable into parts along a separation line so as to open and provide access to an interior thereof; and wherein said separation line is generally longitudinally disposed.

5. A spinning device for the production of a spun thread from a fiber bundle, comprising:

a nozzle block defining a fiber conveying channel having a fiber guide surface, said nozzle block further comprising a nozzle part with at least one nozzle disposed to subject the fiber bundle to a rotating turbulent air flow;

a spindle having a yarn channel with an intake mouth disposed to take up fibers delivered from said fiber guide surface and to guide the spun fibers;

wherein at least one of said yarn channel, said nozzle part, and said spindle is separable into parts along a separation line so as to open and provide access to an interior thereof; and wherein said spindle comprises a movable part separable from a stationary part, and further comprising a ring element that remains secured to said stationary part upon separation of said movable part therefrom.

6. A spinning device for the production of a spun thread from a fiber bundle, comprising:

a nozzle block defining a fiber conveying channel having a fiber guide surface, said nozzle block further comprising a nozzle part with at least one nozzle disposed to subject the fiber bundle to a rotating turbulent air flow;

a spindle having a yarn channel with an intake mouth disposed to take up fibers delivered from said fiber guide surface and to guide the spun fibers;

wherein at least one of said yarn channel, said nozzle part, and said spindle is separable into parts along a separation line so as to open and provide access to an interior thereof; and wherein said spindle comprises a movable part separable from a stationary part, and further comprising a ring element that remains secured to said movable part upon separation of said movable part from said stationary part.

7. A spinning device for the production of a spun thread from a fiber bundle, comprising:

a nozzle block defining a fiber conveying channel having a fiber guide surface, said nozzle block further comprising a nozzle part with at least one nozzle disposed to subject the fiber bundle to a rotating turbulent air flow;

a spindle having a yarn channel with an intake mouth disposed to take up fibers delivered from said fiber guide surface and to guide the spun fibers;

wherein at least one of said yarn channel, said nozzle part, and said spindle is separable into parts along a separation line so as to open and provide access to an interior thereof; and wherein said spindle comprises a movable part separable from a stationary part, and further comprising a ring element having a half secured to said stationary part and an opposite half secured to said movable part.

* * * * *